US005505412A

United States Patent [19]

Van Hamme

[11] Patent Number: 5,505,412

[45] Date of Patent: Apr. 9, 1996

[54] WHEEL CHAIR ARM BOARD AND METHOD OF MAKING SAME

[75] Inventor: Eugene P. Van Hamme, Grimes, Iowa

[73] Assignee: Iowa Health System, Des Moines, Iowa

[21] Appl. No.: 250,047

[22] Filed: May 27, 1994

[51] Int. Cl.[6] ..... B68G 5/00

[52] U.S. Cl. ..... 248/118; 297/188.18; 297/DIG. 4

[58] Field of Search ..... 248/118; 297/188.18, 297/DIG. 4, 188.14, 188.2; 5/937, 623, 646, 647

[56] References Cited

U.S. PATENT DOCUMENTS

| | | | |
|---|---|---|---|
| 4,548,326 | 10/1985 | Danna | 297/188.18 X |
| 4,575,149 | 3/1986 | Forestal | 297/188.18 X |
| 4,576,351 | 3/1986 | Brink | 248/118 |
| 4,784,120 | 11/1988 | Thomas | 5/647 X |
| 5,060,638 | 10/1991 | Bodine | 297/DIG. 4 X |
| 5,074,617 | 12/1991 | Maxwell | 297/DIG. 4 X |
| 5,149,033 | 9/1992 | Burzler | 248/118 X |
| 5,238,212 | 8/1993 | Dechellis | 297/188.18 X |

OTHER PUBLICATIONS

Invacare Corporation, Invacare® Innovation in Health Care™ ©1992, 4 page brochure, Elyria, Ohio.

Smith & Nephew Rofyam, 1994 Activities of Daily Living Products, 1994 7 pages, Germantown, Wisc.

Enrichments, Products to Enhance Your Life Enrichments, Spring/Summer 1994, 6 pages, Western Springs, IL.

Smith & Nephew, 1994 Product Catalog, 1994, 7 pages, Germantown, Wisc.

*Primary Examiner*—J. Franklin Foss

*Attorney, Agent, or Firm*—Zarley, McKee, Thomte, Voorhees, & Sease

[57] ABSTRACT

An arm board for removable placement on wheel chair arms. The platform of the arm board upon which the wheel chair users arm rests is premanufactured to have multiple mounting locations for mounting members to the wheel chair arm. It therefore can be interchanged between left and right wheel chair arms. According to another aspect of the invention, the board can be slid over a wheel chair arm and arm rest, by utilizing a mounting bracket combination, without removing the arm rest.

17 Claims, 7 Drawing Sheets

WHEEL CHAIR ARM BOARD AND METHOD OF MAKING SAME

BACKGROUND OF THE INVENTION

A. Field of the Invention

The present invention pertains to an auxiliary arm support for wheel chairs, commonly called an arm board, which are used to support the wheel chair user's incapacitated or paralyzed arm.

B. Problems in the Art

Arm boards per se are well known in the art. Conventional wheel chairs have tubular arms with horizontal portions on opposite sides of the wheel chair seat. Normally, a relatively narrow arm rest pad is placed along that horizontal portion so that the wheel chair user can rest his/her arms or elbows if needed.

These chair arms and arm rests are designed for resting or temporary support of functioning arms of the user, as opposed to disabled or paralyzed arms.

Arm boards are generally significantly wider and longer than the conventional wheel chair arm rest pad to provide a large surface to rest the disabled or paralyzed arm. Most times some sort of restraining or retaining member is also used to either strap or hold the disabled or paralyzed arm on the arm board.

As can be appreciated, some wheel chair users require an arm board for their left arm, others for their right arm. Some require an arm board for both arms. Many times, it is not possible to create a standardized arm board because of the different sizes and needs of individual users.

A conventional way of making an arm board is to take a flat rectangular piece of wood, remove the wheel chair arm rest, position the board on the wheel chair arm (without arm pad) and then drill holes in the board and bolt the board in place of the arm pad. The board is then covered with a pad and usually some material such as vinyl. While this method provides a sturdy arm board, it requires such steps as removing the arm pad, aligning and drilling holes to match those of the wheel chair, attaching the board and then attaching a pad and cover. This is a labor intensive and time consuming endeavor.

An improvement to this method leaves the arm pad on the wheel chair arm and instead makes a slide on mounting bracket from wood that is screwed or bolted to the bottom of the arm board. The arm board with bracket is then slid over the wheel chair arm and arm rest. The primary problems with this method are that it is time consuming, labor intensive, and somewhat complex to accurately cut out the brackets from wood pieces, connect them to the arm board, and then cover the arm board with the pad and cover. A primary deficiency with such a method is that once the bracket is installed, it is effectively permanent. To remove it might require removal of the cover and pad.

Further deficiency with known methods of making arm boards is that they are dedicated to either the left or right arm of the wheel chair and normally cannot be universally used or easily adapted for either chair arm. Further, it is often difficult to slide an arm board with wood mounting brackets over a vinyl arm pad without substantial friction or the risk of tearing the arm pad.

A primary consideration is the amount of time and labor necessary to manufacture and customize arm boards for particular patients for particular sides of the wheel chair. A reduction in the time and effort required to construct such arm boards coupled with increased flexibility has been identified as a need in the art.

It is therefore a principal object of the present invention to provide a wheel chair arm board and method of making the same which solves and/or improves over the problems and deficiencies in the art.

Another object of the present invention is to reduce the amount of time and labor needed to make arm boards.

Another object of the present invention is to increase the flexibility of use of the arm board; for example, its adaptability to either the left or right arm of a wheel chair with or without arm pad without essentially re-manufacturing the arm board.

Another object of the present invention is to increase the mountability of the arm board, for example, the ease by which it can be mounted to the wheel chair.

Another object of the present invention is to provide a measure of portability and reusability based on the ease of construction, flexibility, and ease of mounting of the arm board.

Another object of the present invention is to reduce the number and types of arm boards kept in inventory because of the universality of the invention.

Another object of the present invention is to provide safety, strength, and durability, as well as deter any loosening or movement of the arm board once mounted on the wheel chair.

Another object of the present invention is to provide a more economical arm board and method of making the same.

These and other objects, features, and advantages of the present invention will become more apparent with reference to the accompanying claims and specification.

SUMMARY OF THE INVENTION

The present invention relates to arm boards used with wheel chairs. A first feature according to the invention utilizes mounting members built into the platform. The mounting members are built-in to allow the arm board to be reversible for either left or right wheel chair arms. Mounting members either allow direct attachment to the wheel chair arm with bolts, or allow attachment of mounting brackets to the platform of the arm board which then allow the arm board to be slid over the wheel chair arm and arm pad.

Another feature that can be used with the invention uses a polyurethane material as a part of the mounting brackets of the arm board to facilitate easier slideable mounting to the wheel chair arm and arm pad.

Another aspect according to the invention includes the use of non-complex shapes and sizes of pieces to create the mounting brackets to reduce labor and to economize inventory.

Another aspect of the invention involves the method of making an arm board including utilizing a jig to simulate the size and shape of an arm rest pad, provide a drilling jig, and building the mounting bracket around that jig for accurate positioning of parts.

Another aspect according to the invention utilizes an arm board with side walls and stabilizing walls on opposite sides of the arm board which function to retain the arm from lateral movement and which utilizes the wheel chair framework, and to some extent the user's body to hold the assembly in place on the arm board without direct attachment to the wheel chair.

Other aspects and features according to the invention will become apparent with reference to the entirety of the specification and claims.

DETAILED DESCRIPTION OF THE PREFERRED EMBODIMENT

Figure 1:
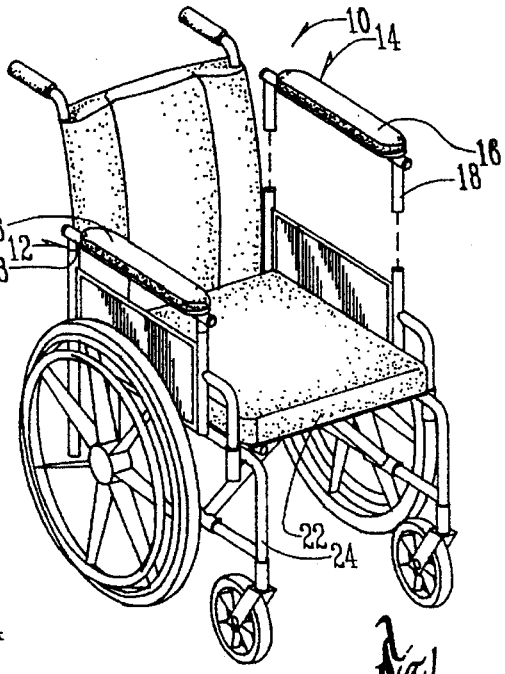
Fig. 1 (PRIOR ART)
FIG. 1 is a perspective view of a conventional wheel chair showing in exploded fashion a removable wheel chair arm and arm pad.

A preferred embodiment according to the invention will now be described in detail. Reference will be taken frequently to the appended drawings. Reference numbers and letters are used in this description and in the drawings to indicate certain parts and locations in the drawings. The same reference numerals will be used to indicate the same parts and locations throughout the drawings unless otherwise indicated.

FIG. 1 illustrates a wheel chair 10 having left and right arms 14 and 12. An arm pad 16 is secured to horizontal section 18 of each arm 12 and 14 by bolts (see, e.g., FIG. 13). A seat 22 is supported by frame 24.

Figure 2:
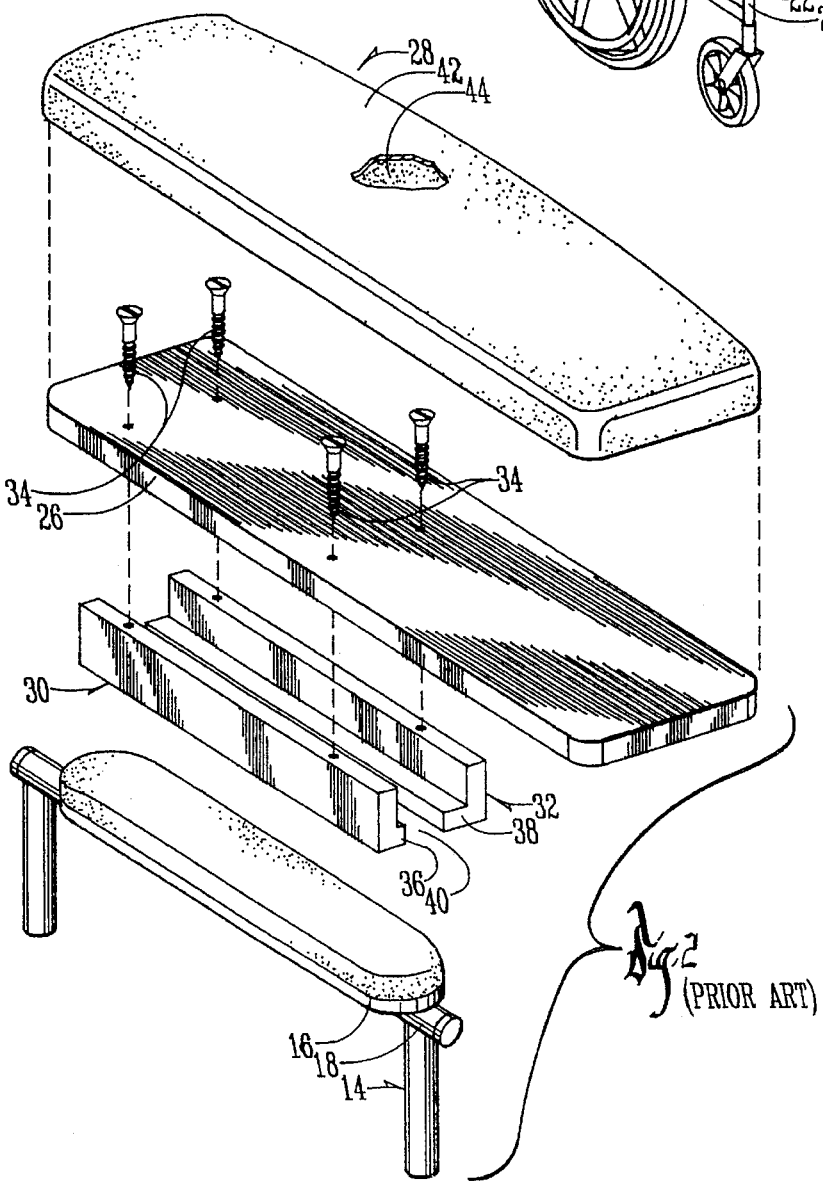
Fig. 2 (PRIOR ART)
FIG. 2 is an enlarged isolated view of a wheel chair arm and pad, and a prior art arm board in exploded view.

FIG. 2 shows a prior art arm board usable with wheel chair 10 of FIG. 1. What will be called platform 26 of arm board 28 is conventionally a rectangular wood piece. Facing L-shaped members 30 and 32 are mounted to the bottom of platform 26 by screws 34 or other fasteners. L-shaped member 30 has a narrower distal perpendicular portion 36 than the corresponding portion 38 of member 32. Members 30 and 32 are basically parallel and define a gap 40 between sections 36 and 38. A cover (for example, vinyl) 42 and resilient cushion 44 (foam rubber for example) can be secured to platform 26 once members 30 and 32 are fastened to platform 26. Generally cover 42 wraps around the edges of platform 26 and is stapled or otherwise fastened in an essentially permanent manner to platform 26.

Figure 3:
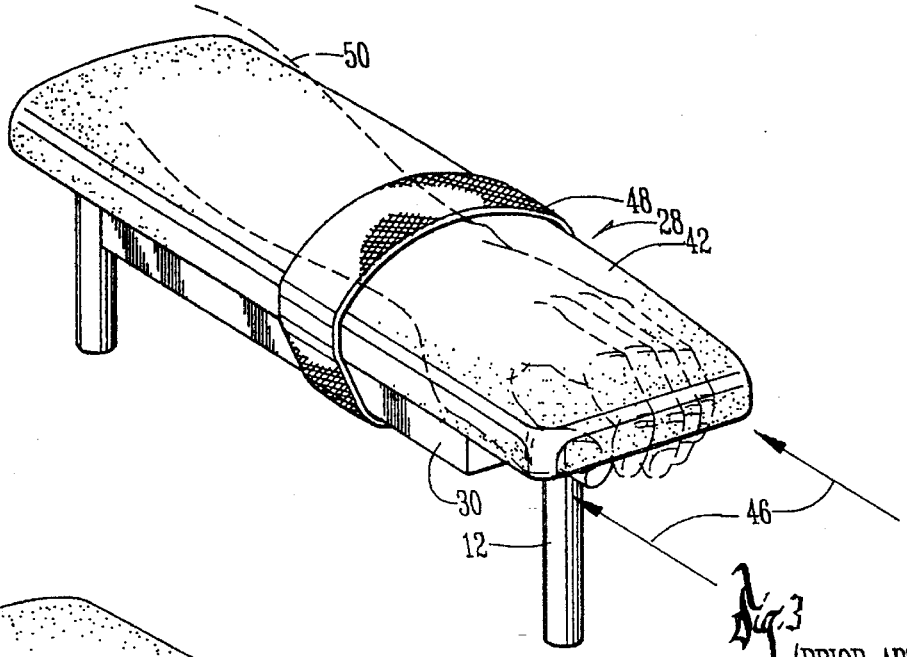
Fig. 3 (PRIOR ART)
FIG. 3 is an assembled view of FIG. 2 depicting diagramatically the placement of the wheel chair user's arm on the arm board.

FIG. 3 illustrates that once the prior art arm board 28 of FIG. 2 is assembled, it can be positioned so that it is slid in the direction of arrows 46 onto arm 12 or 14 and then over pad 16.

In FIGS. 2 and 3 it should be noted that platform 26 generally extends forwardly of the wheel chair arm 14 to provide a support for the entire forearm and hand (reference numeral 50) of the wheel chair user. As can be seen in FIG. 2, this requires screws 34 to be positioned in the back near corner of platform 26 so that members 30 and 32 also are positioned underneath platform 26 at the back near corner, so that bore 26 ends up in the position shown in FIG. 2. Thus, considerable time and effort needs to be spent to accurately position the holes or screws 34.

Also, FIG. 2 shows that at least in the preferred embodiment, portion 36 of member 30 is smaller than portion 38 of member 32. Portion 36 extends approximately ¼" from a vertical part of member 30; whereas portion 38 extends approximately ⅞" in the preferred embodiment. This is because many arm pads 16 of conventional wheel chairs are off center on horizontal section 18 of arm 12 or 14. This makes the construction of prior art arm boards 28, and particularly members 30 and 32, more difficult because each are differently sized and shaped. In the prior art members 30 and 32, the vertical side walls are generally between 1" to 2" in height. They are approximately 10" to 11" in length. These distances can vary, however depending on a particular wheel chair.

One of the primary difficulties with the prior art arm board 28 is as follows. It is very time consuming and somewhat complex to make. Members 30 and 32 are difficult to cut out of wood because of their perpendicular portions. No good way is known as to how to position members 30 and 32 accurately so that they fit in such a relationship that the entire arm board 28 easily slides onto wheel chair arm 12 or 14, but yet is snug enough that it essentially by interference fit or friction stays in place over arm pad 18 and arm 16. Moreover, members 30 and 32 must be fastened to platform 26 before cover 42 and pad 44 are placed over and secured to platform 26. Once all this work is done, it is difficult to go back and alter any of the components. Furthermore, the design of arm board 28 must be designed and manufactured for either left wheel chair arm 12 or right wheel chair arm 14 and normally is not interchangeable to either arm.

FIG. 3 shows that conventionally some sort of retaining strap 48 is combined with arm board 28 to hold the disabled or paralyzed patient arm 50 in place on arm board 28. Strap 48 can use any of a number of conventional components to either permanently fasten it to arm board 28 and releasably secure it around patient arm 50. For example, one end of strap 48 can be sewn to or stapled to arm board 28. Hook and loop material could be used to secure the strap to itself around arm 50. Other types of fastening, both permanent and releasable can be used. Alternatively, strap 48 can simply be placed around arm board 28 and arm 50 and secured with respect to itself to clamp arm 50 to board 28, but be non-attached to board 28.

Figure 4:
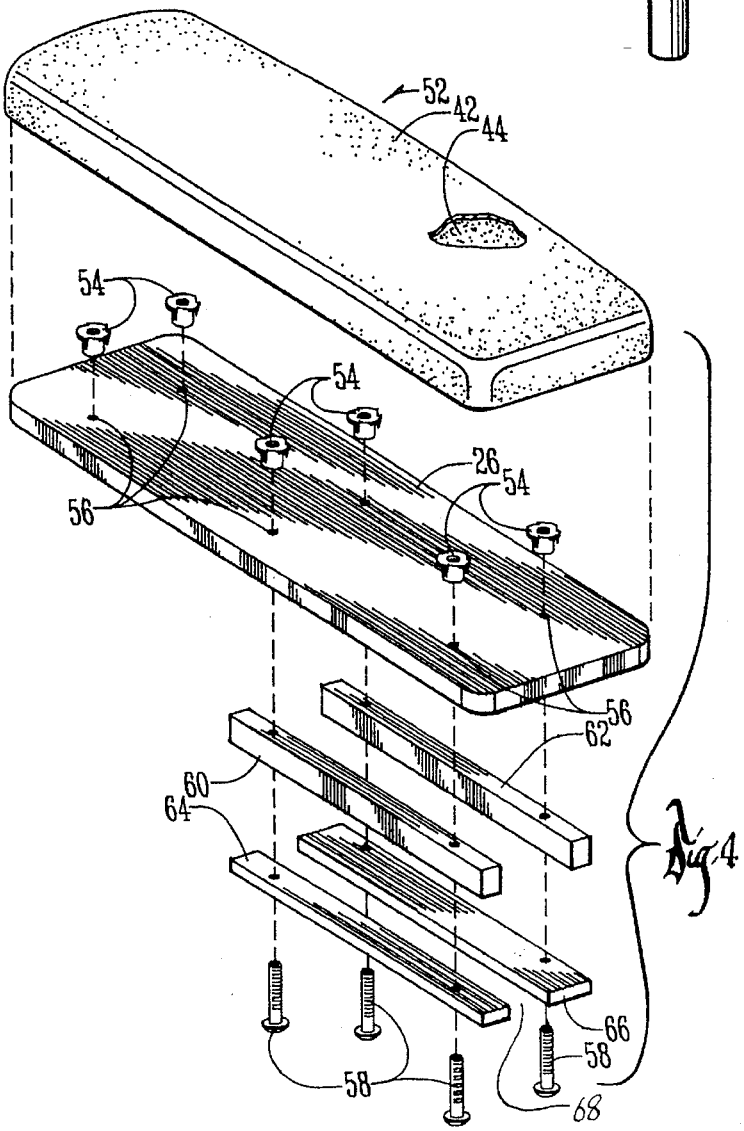
FIG. 4 is an exploded view of an arm board according to the present invention.

FIG. 4 shows an embodiment according to the present invention. Platform 26, cover 42, and cushion 44 are also used with this embodiment of an arm board, referred to as arm board 52. However, arm board 52 utilizes T-nuts 54 which are secured through holes 56 in board 52. T-nuts 54, as is well known in the art, have threaded receiving channels that receive threaded bolts 58. The heads of T-nuts 54 can contain teeth or other means to bite into board 52 (for example, if it is wood) and hold T-nuts 54 in place. Essentially T-nuts 54 become built-in mounting members. A prime advantage of use of T-nuts 54, or similar components, is that once positioned where desired in board 52, cover 42 and cushion 44 can then be secured prior to installation of board 52 to the wheel chair or with respect to any other structure.

The embodiment of FIG. 4 also includes spacer bars 60 and 62 (which are generally identically sized elongated pieces) and flanges 64 and 66. As shown in FIG. 4, once assembled, spacer bars 60, 62, and flanges 64, 66 mimic the L-shaped members 30 and 32 of FIG. 2 by defining a gap 68 between facing edges of flanges 64 and 66 to allow passage of wheel chair arm 12 or 14, and the interior space between facing sides of spacer bars 60 and 62 being capable of receiving snugly arm pad 16.

In the embodiment of FIG. 4, arm board 52 is 1½" by 7½" by 22" plywood. Spacer bars 60 and 62 are ¾" by 1¼" by 11" hardwood pieces. Flange 64 is a white polyurethane slide ⅜" by 1 1/16" by 11", whereas flange 66 is a white polyurethane slide ⅜" by 1¾" by 11".

Cover 42 is black vinyl or Naugahyde™ 11½" by 26" and cushion 44 is polyfoam 1" by 7½" by 22".

A strap 48 can be used with the embodiment of FIG. 4 and can be a black webbing material 2" by 21". A 2" by 6" loop section can be attached to webbing or strap 48 and used in combination with 2" by 6" hook portion as the means to secure the strap around board 52 and an arm 50.

Figure 5:
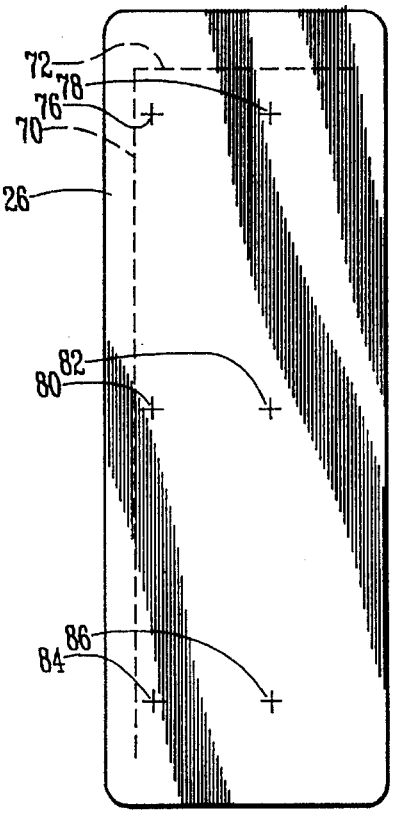
FIG. 5 is a top plan view of the arm board platform of FIG. 4.
Figure 6:
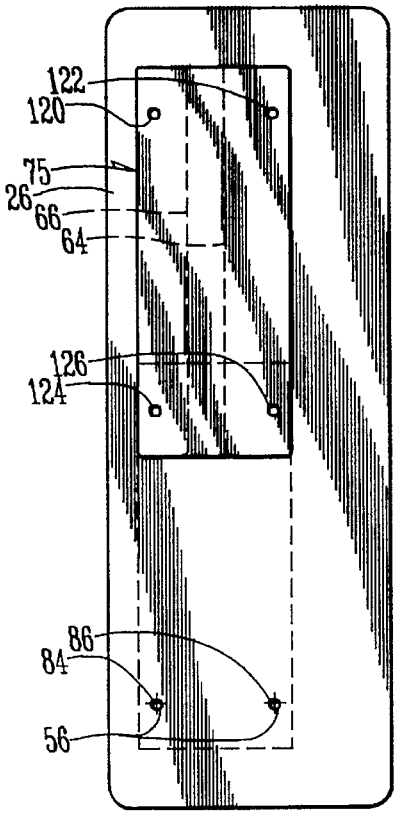
FIG. 6 is a top plan view of FIG. 5 including a jig and mounting brackets associated with the method of making an arm board according to the present invention.
Figure 7:
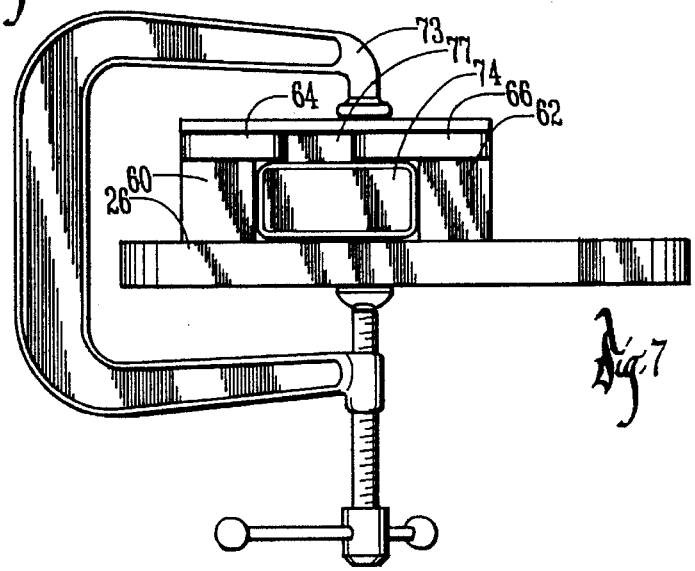
FIG. 7 is an end plan view of FIG. 6.

FIGS. 5–7 assist in an understanding of how the embodiment of FIG. 4 can be made. FIG. 5 shows a bottom view of platform 26.

The first step is to draw a line (reference number 70) ¾" and parallel with an edge of board 26 and a line (reference number 72) ½" from one end of board 26. In the preferred embodiment, a 6" "C" clamp is inserted in a vice and secured (see example C-clamp 73 in FIG. 7).

FIG. 5 shows where eventually two sets of T-nuts will be inserted in board 26 to provide two alternative mounting locations for pieces 62, 66, and 60, 64. FIG. 5 indicates the future position of such two sets (the first set being holes 76, 78, and 80, 82; the second set being holes 80, 82, and 84, 86).

Next, one piece 74 of what is called an assembly jig is placed on board 26, spacer bars 60 and 62 are placed on opposite sides of piece 74 (see FIG. 7), and flanges 64 and 66 are laid on top of spacer bars 60 and 62 and extend over a portion of piece 74 (see FIG. 7). The whole combination of spacer bars 60 and 62, piece 74, and flanges 64 and 66 is then moved to correspond so that the combinations perimeter corresponds with lines 72 and 70 as shown in FIG. 5.

As can be seen in FIG. 7, piece 74 of the assembly jig is a rectangular in cross-section piece (can be wood) which is pre-configured to simulate the length, width, and depth of the wheel chair pad 18 to which arm board 52 is to be attached. The height of spacer bar 60 and 62 has been previously correlated to the height of the arm pad so that piece 74 basically insures the correct lateral spacing between spacer bar 60 and 62 when assembling arm board 52. Second piece of the assembly jig (reference number 77) can be placed between flanges 64 and 66 to insure their lateral spacing along their length. (Pieces 74 and 77 could be one premade piece). A third piece of the assembly jig (reference numeral 75) consists of a piece (can be a plate made of for example metal) that is premanufactured to conform generally to the desired perimeter dimensions of spacer bar 60 and 62, and flanges 64 and 66 when assembled as shown in FIG. 7. Piece 75 includes pre-drilled holes 120 and 122, and 124 and 126 that are pre-designed to correspond exactly with axes that would go essentially through flanges 64 and 66 and through substantially the middle of spacer bars 60 and 62. Holes 120, 122, and 124, 126 are pre-designed to allow essentially a drilling jig to create holes 76, 78, and 80, 82 in platform 26. FIG. 7 shows how C-clamp 73 is used to clamp the entire assembly, including assembly jig pieces 74 and 75 into position on platform 26. It is to be understood that the outer sides of pieces 64 and 66, and 60 and 62 are generally aligned with the outer perimeter of assembly jig piece 75.

By referring to FIG. 6, what will be called a first set of holes 76, 78 in platform 26 are drilled through drilling jig piece 75, into and through flanges 64 and 66 and spacers 60 and 62 and into and through board 26 while the whole combination is clamped by the "C" clamp 73 and secured in position. A second set of holes 80, 82 are drilled at the opposite endof the assembly and into board 26. It is to be understood as shown in FIG. 6 that holes 76, 78, 80, and 82 are outside of piece 74.

Clamp 73 is loosened and the entire combination is then moved down the board (see ghost lines in FIG. 6) so that drilling jig piece 75 holes 120 and 122 align with just previously drilled holes 80 and 82 in board 26 and a third set of holes 84, 86 are then drilled into board 26. This procedure essentially efficiently produces two mounting locations for the combination of space bars 60, 62 and flanges 64, 66, one for the right hand arm of the wheel chair, and one for the left hand arm.

In the preferred embodiment the holes are drilled ¼" wide. Once three sets of holes are drilled, the combination of jig pieces 74, 77, and 75, spacer bars 60, 62 and flanges 64, 66 are removed and the three sets of holes in board 26 are drilled from ¼" to 5/16" size. On the opposite side of arm board 26, 65/16" T-nuts are driven into the holes.

Next, all pieces are smoothed and all corners are rounded. The combination is then assembled together after selecting which of the two mounting positions is desired using four 2" round head bolts.

The 1" polyfoam and black Naugahyde™ cover 44 and 42 can either be secured to board 26 after driving the T-nuts into the holes or after assembly of all the parts except for cover 42 and cushion 44. Finally, if desired strap 48, or even multiple straps 48 can be attached to board 26.

Figure 8:
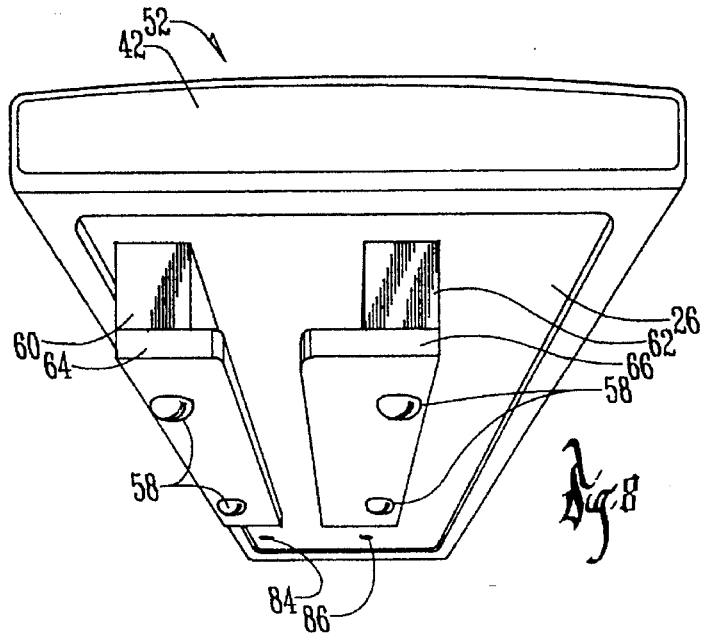
FIG. 8 is a bottom perspective view of an assembled arm board of FIG. 4.

FIG. 8 shows the embodiment of FIG. 4 in assembled form. In this instance a right arm mounting position has been chosen by placing spacer bars and flanges 60, 62, 64, 66 nearest the back left hand corner of board 26. The front of the board therefore extends forward to support the distal portion of the user's arm including the hand. If mounted to the other mounting position it would be a left arm board. The use of polyurethane for flanges 64 and 66 converts those flanges into glides or sliders to assist in smooth mounting the arm board. The use of the piece 74, which is carefully sized to simulate the dimensions of the arm rest 16, insures that it will snugly fit over the arm rest and keep in position. This eliminates any retro adjustments or waste as far as mistakes in measurement.

Figure 9:
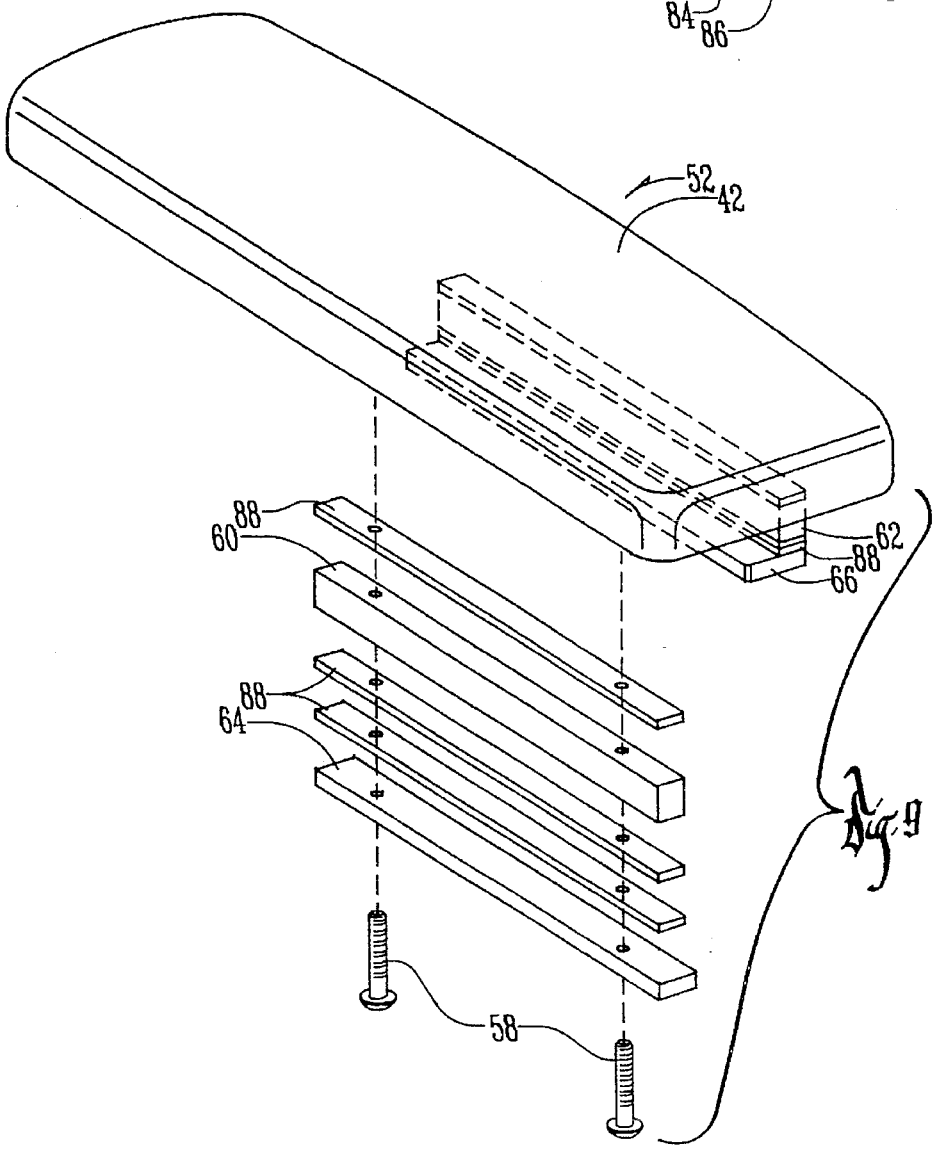
FIG. 9 is an exploded view illustrating the use of shims with the mounting brackets with the embodiment of FIG. 4.

FIG. 9 clearly shows that shims 88, comprising elongated flat pieces of wood or other material, can be used by placement between a spacer bar 62 or 64 and either (or both) flange 64 or 66, and platform 26 to adjust for different sized arms and arm pads. Thus, the sizing of spacer bars 60 and 62 is not as critical and customization work is minimized.

Figure 10:
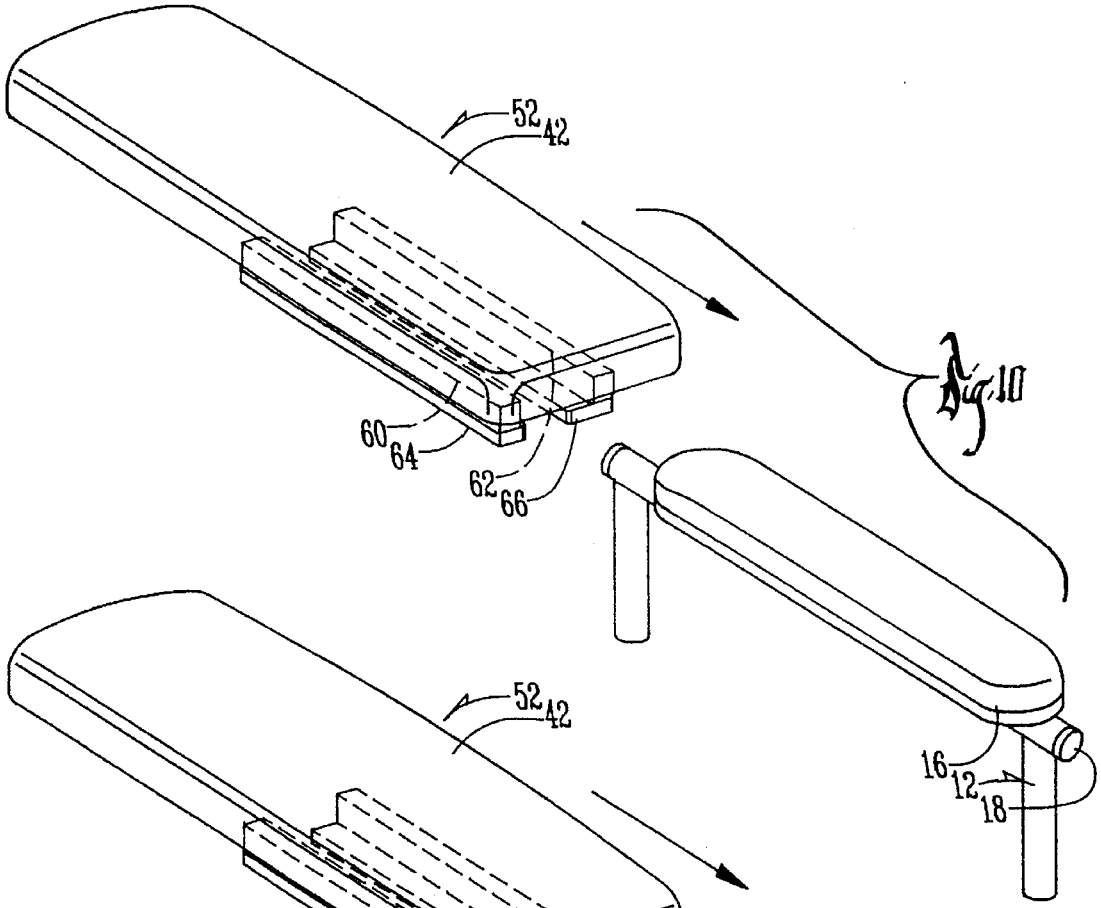
FIG. 10 is a perspective partial view showing the embodiment of FIG. 4 prior to being inserted onto a wheel chair arm.
Figure 11:
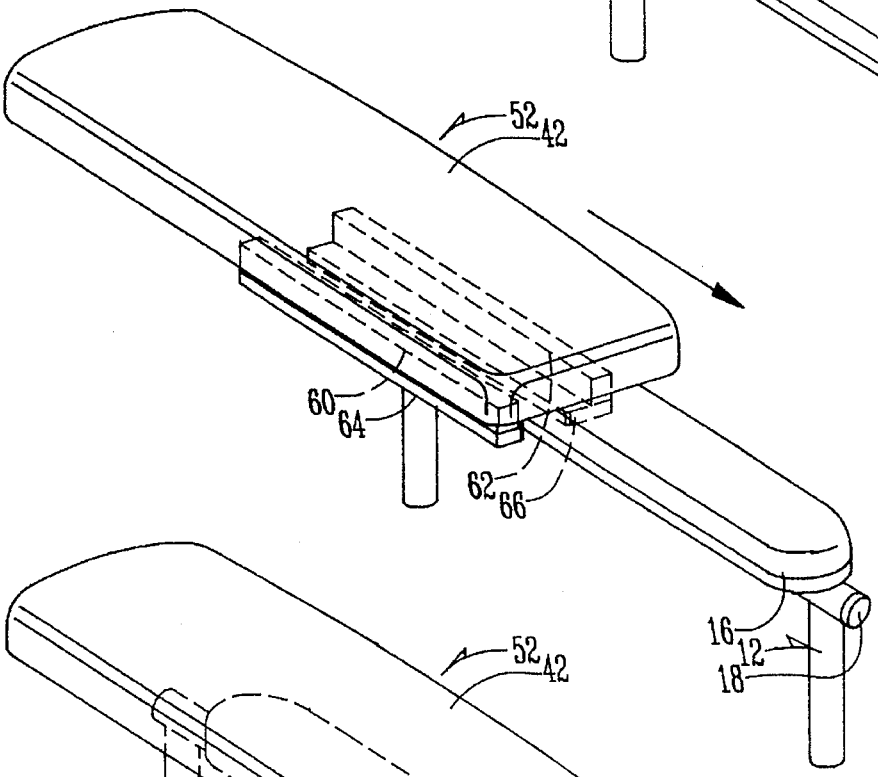
FIG. 11 is similar to FIG. 10 but showing the arm board of FIG. 4 partially inserted on a wheel chair arm.
Figure 12:
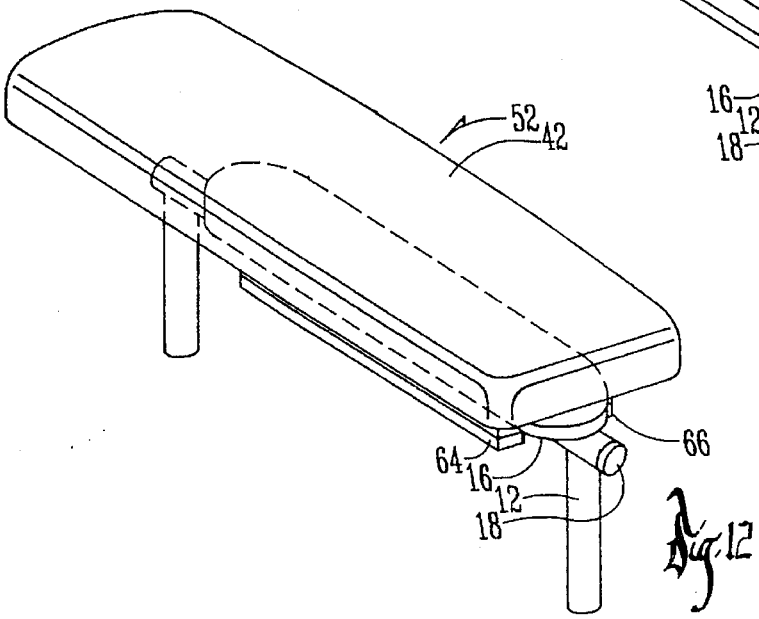
FIG. 12 is a view similar to FIG. 10 showing the arm board fully mounted on the wheel chair arm.

FIGS. 10–12 depict how the assembled arm board 52 is slid onto arm 14 and over arm pad 16.

Figure 13:
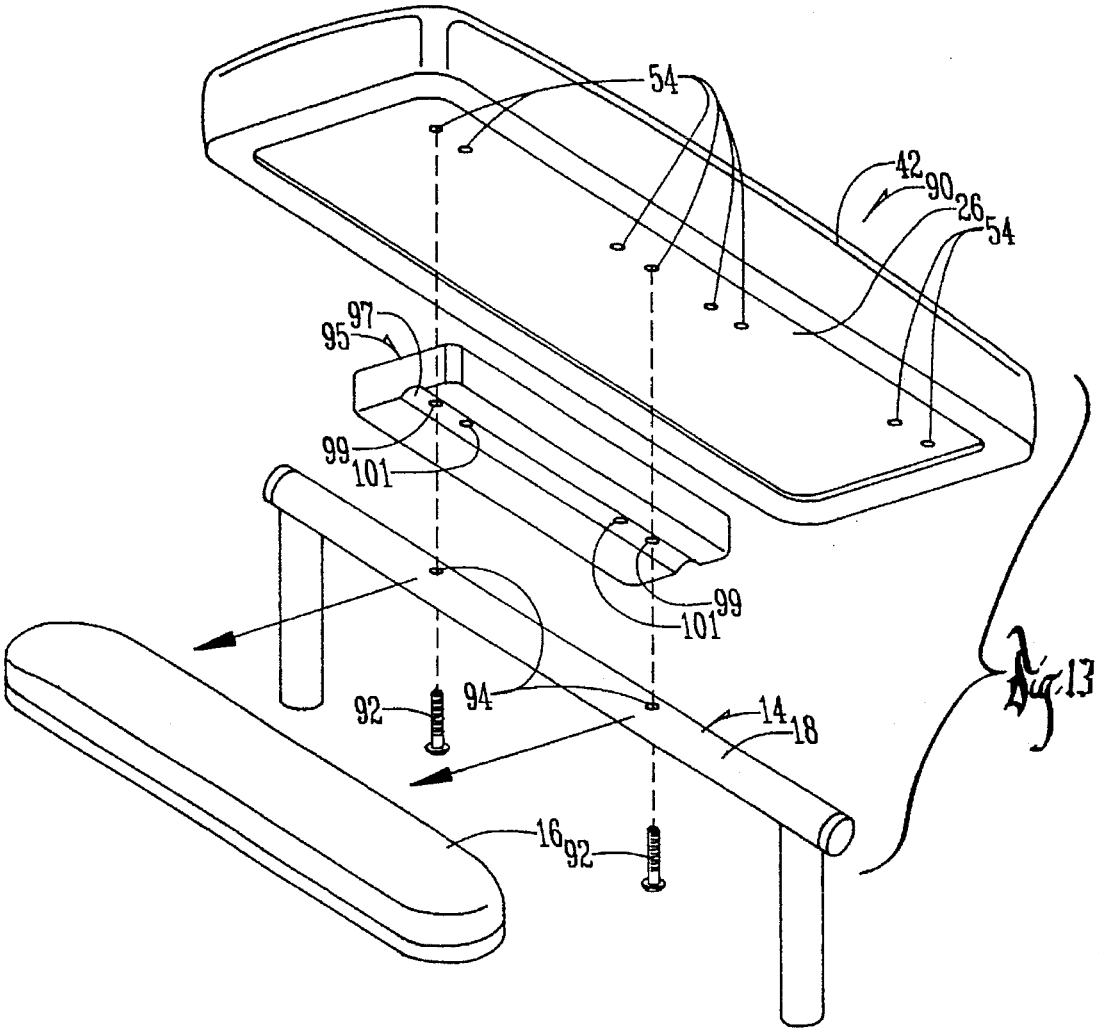
FIG. 13 is an exploded perspective view of an alternative embodiment of the present invention which replaces the removed conventional arm pad on the wheel chair arm.

FIG. 13 illustrates another embodiment according to the present invention. Arm board 90 consists of platform 26, cover 42, and pad 44 (not shown). In this instance, it is sometimes desirable to remove wheel chair arm pad 16 by removing any screws or bolts that extended through holes 94 in arm 12 or 14. In this instance, eight T-nuts 54 are installed in platform 26 as previously described, however, the set of four to the left in FIG. 13 are to attach board 90 to the left arm 14 of the wheel chair. Four T-nuts are installed at each end of board 90 to allow for two spacings between holes 94 in arm 12 or 14. The set of four T-nuts 54 to the right are to attach board 90 to the right arm 12. Each set of T-nuts 54 is spaced apart so that the distance between each is the equivalent to the distance between holes 94 (which can vary from wheel chair type to type). This effectively provides two mounting locations (right and left side) for arm board 90. A middle member 95 (can be made of wood), includes a sculpted concave channel 97 that mates with the exterior curvature of arm 14. It also includes two sets of holes (the first set shown by reference numeral 99, the second set by 101). The two sets of holes are positioned to correspond with two conventional spacings for holes 94 in wheel chair arms. Only two holes are needed. The right or left mounting position is selected and bolts 92 (e.g. 3/16"×1¾" round head stove bolts) are placed through holes 94, through either holes 99 or 101 in member 95, and into T-nuts 54 to secure arm board 90 in place.

Figure 14:
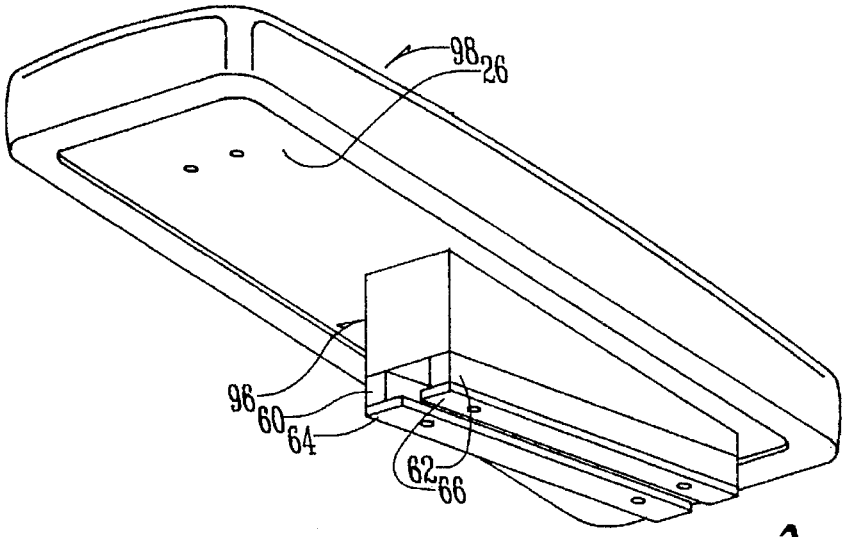
FIG. 14 is perspective view of an alternative embodiment of the invention which is similar to FIG. 4 but includes a ramp or incline portion which inclines the platform of the arm board relative to the wheel chair user.

FIG. 14 shows another alternative embodiment according to the present invention. It is essentially identical to the embodiment of FIGS. 4 and 8 except a ramp section 96 is secured by means well within those skilled in the art, between spacer bars 60 and 62 and the bottom of platform 26 so that platform 26 would be inclined with respect to horizontal portion 16 of wheel chair arm 12 or 14. Different mounting positions could be built into this arm board 98 similar to as described with regard to other embodiments. Additionally, the embodiment of FIG. 4 could be mounted to wheel chair arm either by slide on mounting assembly or direct mount to the arm as previously described.

Figure 15:
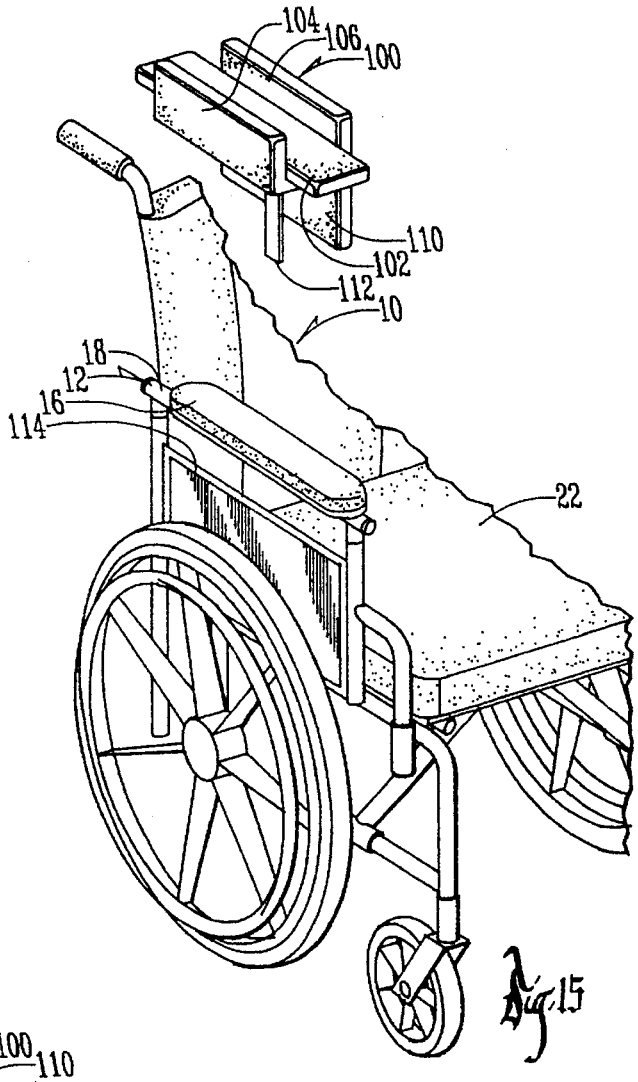
FIG. 15 is a perspective view of an alternative embodiment of the invention prior to mounting upon a wheel chair.
Figure 16:
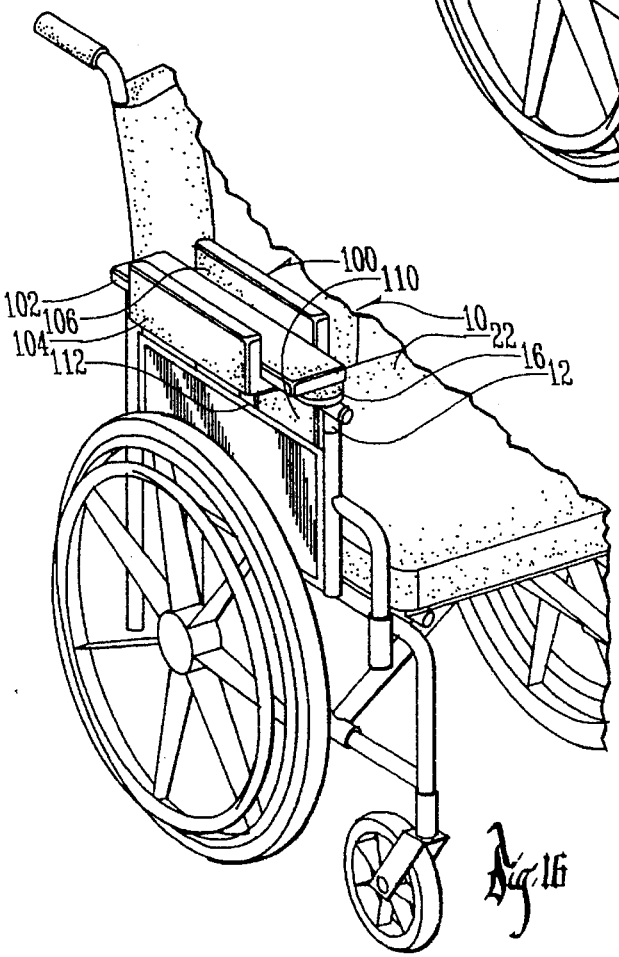
FIG. 16 is similar to FIG. 15 except showing the arm board mounted to the wheel chair.

FIGS. 15 and 16 show a still further embodiment according to the present invention. Arm board 100 consists of a platform 102 which can be covered by a cushion and vinyl cover as previously described (not shown). Vertical wall sections 104 and 106 extend from opposite lateral sides of platform 102 to form a channel 108 in which a users arm can be laid and retained. A stabilizing wall section 110 can extend below platform 102 (in this case is unitary with vertical wall 106). It is essentially manufactured to be of a size which would fit between arm 12 and seat 22 of wheel chair 10 and can utilize a bar 112 (made, for example, from bar stock aluminum and screwed or bolted along the side of section 110), which passes between seat 22 and the frame portion 114 adjacent to seat 22 (essentially between the wheel chair frame and the frame of the arm). FIG. 15 shows arm board 100 before installation on wheel chair 10. FIG. 16 shows it once installed. Platform 102 would rest on arm rest 18 and stabilizing wall 110 would essentially be positioned between the body and the user of the wheel chair and arm 12. The body of the user of the wheel chair would then prevent any substantial movement of arm board 100 towards or laterally towards the middle of the wheel chair, and stabilizing wall 110 would prevent arm board 100 from moving laterally away form the wheel chair. Stabilizing wall 110 would rest on the frame 114 of the wheel chair, along with the user's body prevent any rotation of arm board 100 around arm 12. Bar 112 would assist in keeping arm board 100 in place.

This embodiment therefore allows a quick, portable arm board which would not require substantial pre-manufacturing and customization for use. It would be reversible for either arm of the wheel chair. Wall 104 could also include a downwardly extending portion extending below board 102 (this portion is not shown), which could also serve to retain arm board 100 on arm pad 18. A strap 48 (not shown) could also be used with this embodiment.

It will be appreciated that the present invention can take many forms and embodiments. The true essence and spirit of this invention are defined in the appended claims, and it is not intended that the embodiment of the invention presented herein should limit the scope thereof. Variations are obvious to one skilled in the art will be included within the invention defined by the claims.

I claim:

1. An auxiliary arm support for wheel chair including right and left arms having a width and being positioned on opposite sides of a seat, and right and left arm rests having a length, a width, and a central longitudinal axis and being attachable offset from the longitudinal axis to the tops of the right and left arms respectively by bolts extending through a spaced apart set of apertures in each arm, said auxiliary arm support comprising:

a platform having a top and bottom;

mounting members built into the platform at one of at least two alternative positions, one position for mounting the platform over the right arm rest and to the right arm and another position for mounting the platform over the left arm rest to the left arm so that the auxiliary arm support can be slidably mounted to either right or left arm of the wheel chair without additional manufacturing; and a cover and pad secured over the top of the platform.

2. The auxiliary arm support of claim 1 wherein the mounting members comprise T-nuts mounted and fixed against rotation in the platform.

3. The auxiliary arm support of claim 1 wherein the pad is attached by non-releasable fasteners to the platform.

4. The auxiliary arm support of claim 1 further comprising a retaining strap mounted surrounding the platform to retain a wheel chair user's arm to the platform.

5. An auxiliary arm support for wheel chair including right and left arms having a width and being positioned on opposite sides of a seat, and right and left arm rests having a length and a width and attachable to the tops of the right and left arms respectively by bolts extending through a spaced apart set of apertures in each arm, said auxiliary arm support comprising:

a platform having a top and bottom;

mounting members built into the platform at one of at least two alternative positions, one position for mounting the platform to the right arm and another position for mounting the platform to the left arm so that the auxiliary arm support can be mounted to either right or left arm of the wheel chair without additional manufacturing;

a cover and pad secured over the top of the platform; and the mounting members comprising threaded receivers, elongated spacer bars having interfacing sides spaced approximately the width of an arm rest, flanges positioned on top of the spacer bars having interfacing edges closer than the interfacing sides but farther than the width of the arm, bolts extending through flanges, spacer bars, and into the receivers, so that the auxiliary arm support can be slid longitudinally over the wheel chair arm rest and arm.

6. The auxiliary arm support of claim 5 wherein the flanges are polyurethane elongated members.

7. The auxiliary arm support of claim 5 wherein the spacer bars are rectangular in shape.

8. The auxiliary arm support of claim 5 wherein the flanges are rectangular in shape.

9. The auxiliary arm support of claim 5 further comprising one or more shims positioned between a spacer bar and one of the platform and flange.

10. The auxiliary arm support of claim 5 wherein the flanges are substantially parallel with the platform.

11. The auxiliary arm support of claim 5 wherein the flanges are oblique to the platform.

12. The auxiliary arm support of claim 5 further comprising rounded edges and ends on the flanges, spacer bars, and platform.

13. The auxiliary arm support of claim 5 further comprising beveled oblique surfaces at opposite ends of the flanges to assist in insertion of the auxiliary arm support to a wheel chair arm.

14. An arm board for the support and restraint of a wheel chair user's chair arm, having a frame upon which is supported a seat in a generally horizontal plane and at least one chair arm in a generally vertical plane on one side of the seat comprising:

a generally planer arm board having a top and bottom and opposite ends and sides;

retaining walls extending upwardly with respect to the top of and on opposite sides of the board;

a stabilizer wall rigidly mounted to the board and one of the retaining walls, the stabilizer wall having one side opposite the board and extending downwardly with respect to one side of the board, the one side being placeable between the wheel chair arm and the wheel chair user, the user's body pinning the stabilizer wall to the wheel chair arm;

so that the board rests on top of the wheel chair arm, the retaining walls retain the user's arm to the board, and the stabilizer wall holds the arm support in place without direct connection to the wheel chair.

15. The arm board of claim 14 further comprising a bar connected to the stabilizer wall extending downwardly from the stabilizer wall to pass between the seat and the wheel chair frame to further support and hold the arm board in place during use.

16. The arm board of claim 4 further comprising at least one restraining strap connected to the arm board to retain and restrain the user's arm to the board.

17. The arm board of claim 14 further comprising a wall portion extending downwardly below the board and generally parallel and adjacent to retaining wall opposite the stabilizer wall, to assist in resisting lateral movement of the board relative to the wheel chair arm.

* * * * *